US007423384B2

(12) United States Patent
Ren et al.

(10) Patent No.: US 7,423,384 B2
(45) Date of Patent: Sep. 9, 2008

(54) LAMP VOLTAGE FEEDBACK SYSTEM AND METHOD FOR OPEN LAMP PROTECTION AND SHORTED LAMP PROTECTION

(75) Inventors: Yuancheng Ren, San Jose, CA (US); Kaiwei Yao, San Jose, CA (US); Wei Chen, Campbell, CA (US)

(73) Assignee: Monolithic Power Systems, Inc., San Jose, CA (US)

( * ) Notice: Subject to any disclaimer, the term of this patent is extended or adjusted under 35 U.S.C. 154(b) by 0 days.

(21) Appl. No.: 11/269,086

(22) Filed: Nov. 8, 2005

(65) Prior Publication Data

US 2007/0103096 A1 May 10, 2007

(51) Int. Cl.
*H05B 37/02* (2006.01)
*H05B 41/00* (2006.01)

(52) U.S. Cl. ..... 315/224; 315/312

(58) Field of Classification Search ..... 315/291, 315/307, 224, 209 R, 225, 308, 306, 312; 361/93.1, 93.7, 93.9
See application file for complete search history.

(56) References Cited

U.S. PATENT DOCUMENTS 5,528,192 A 6/1996 Agiman et al.
5,615,093 A 3/1997 Nalbant
5,619,402 A 4/1997 Liu
5,757,173 A 5/1998 Agiman
5,892,336 A 4/1999 Lin et al.
5,923,129 A 7/1999 Henry
5,930,121 A 7/1999 Henry
6,104,146 A 8/2000 Chou et al.
6,198,234 B1 3/2001 Henry
6,198,245 B1 3/2001 Du et al.
6,218,788 B1 * 4/2001 Chen et al. ..... 315/225
6,259,615 B1 7/2001 Lin
6,307,765 B1 10/2001 Choi
6,396,722 B2 * 5/2002 Lin ..... 363/98
6,459,602 B1 10/2002 Lipcsei
6,469,922 B2 10/2002 Choi
6,501,234 B2 12/2002 Lin et al.
6,507,173 B1 1/2003 Spiridon et al.
6,515,881 B2 2/2003 Chou et al.
6,531,831 B2 3/2003 Chou et al.
6,559,606 B1 5/2003 Chou et al.
6,570,344 B2 5/2003 Lin
6,654,268 B2 11/2003 Choi
6,657,274 B2 12/2003 Comeau et al.
6,756,769 B2 6/2004 Bucur et al.
6,781,325 B2 8/2004 Lee et al.
6,809,938 B2 10/2004 Lin et al.
6,853,047 B1 2/2005 Comeau et al.

(Continued)

*Primary Examiner*—Douglas W. Owens
*Assistant Examiner*—Minh Dieu A
(74) *Attorney, Agent, or Firm*—Perkins Coie LLP; Zhou Lu

(57) ABSTRACT

A circuit comprises a detector circuit and a protection triggering circuit in a discharge lamp system. The detector circuit detects both open lamp and shorted lamp conditions and is coupled with detecting devices, such as sensing capacitors. A DC bias is added to the sensing capacitors so that capacitor voltages are always greater than zero volts. The output voltage of the detector circuit is coupled to the protection triggering circuit, which triggers an open lamp protection when open lamp condition occurs and a shorted lamp protection when shorted lamp condition occurs.

26 Claims, 5 Drawing Sheets

A protection triggering circuit using an output voltage from an OR gate detector circuit.

A protection triggering circuit using an output voltage from an AND gate detector circuit.

U.S. PATENT DOCUMENTS 6,856,519 B2 * 2/2005 Lin et al. ..... 363/16
6,864,669 B1 3/2005 Bucur
6,870,330 B2 3/2005 Choi
6,873,322 B2 3/2005 Hartular
6,876,157 B2 4/2005 Henry
6,888,338 B1 5/2005 Popescu-Stanesti et al.
6,897,698 B1 5/2005 Gheorghiu et al.
6,900,993 B2 5/2005 Lin et al.
6,906,497 B2 6/2005 Bucur et al.
6,936,975 B2 8/2005 Lin et al.
6,946,806 B1 9/2005 Choi
6,979,959 B2 12/2005 Henry
6,999,328 B2 2/2006 Lin
7,023,709 B2 4/2006 Lipcsei et al.
7,057,611 B2 * 6/2006 Lin et al. ..... 345/211
7,061,183 B1 6/2006 Ball
7,075,245 B2 7/2006 Liu
7,075,251 B2 * 7/2006 Chen et al. ..... 315/291
7,095,392 B2 8/2006 Lin
7,112,929 B2 9/2006 Chiou
7,112,943 B2 9/2006 Bucur et al.
7,120,035 B2 10/2006 Lin et al.
7,126,289 B2 10/2006 Lin et al.
7,141,933 B2 11/2006 Ball
7,157,886 B2 1/2007 Agarwal et al.
7,161,309 B2 1/2007 Chiou et al.
7,173,382 B2 2/2007 Ball
7,183,724 B2 2/2007 Ball
7,183,727 B2 2/2007 Ferguson et al.
7,187,139 B2 3/2007 Jin
7,187,140 B2 3/2007 Ball
7,190,123 B2 3/2007 Lee et al.
7,200,017 B2 4/2007 Lin
2002/0180380 A1 12/2002 Lin
2005/0030776 A1 2/2005 Lin
2005/0093471 A1 5/2005 Jin
2005/0093482 A1 5/2005 Ball
2005/0093484 A1 5/2005 Ball
2005/0151716 A1 7/2005 Lin
2005/0174818 A1 8/2005 Lin et al.
2005/0225261 A1 10/2005 Jin
2005/0253537 A1 * 11/2005 Jang et al. ..... 315/307
2006/0202635 A1 9/2006 Liu
2006/0232222 A1 10/2006 Liu et al.
2006/0279521 A1 12/2006 Lin
2007/0001627 A1 1/2007 Lin et al.
2007/0046217 A1 3/2007 Liu
2007/0047276 A1 3/2007 Lin et al.
2007/0085493 A1 4/2007 Kuo et al.

* cited by examiner

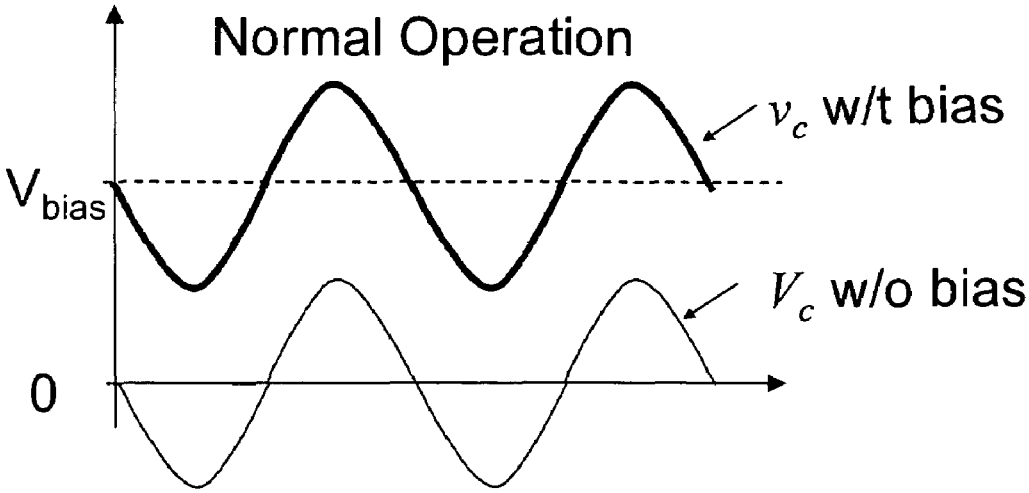
Figure 1. The sensed voltage Vc across a sensing capacitor with and without a DC bias.
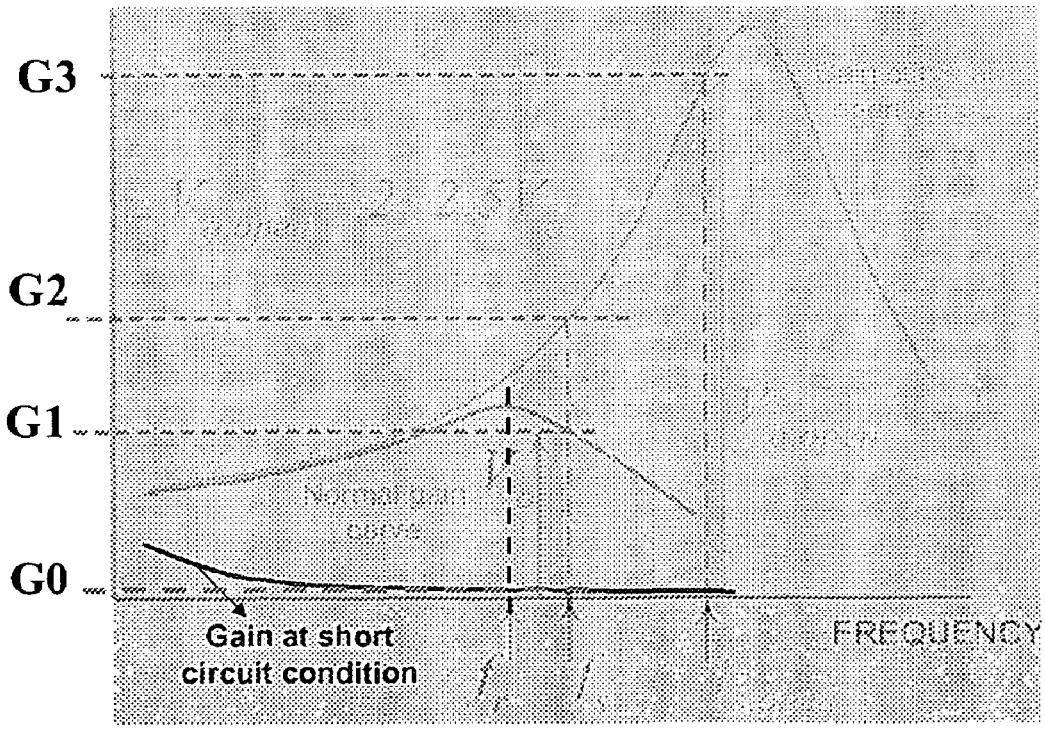
Figure 2. Gain curves of a typical CCFL inverter.

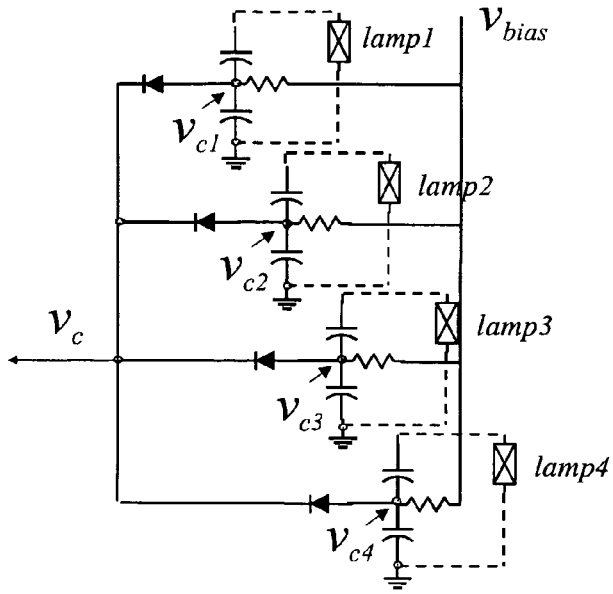
Figure 3. An OR gate detector with a DC bias.
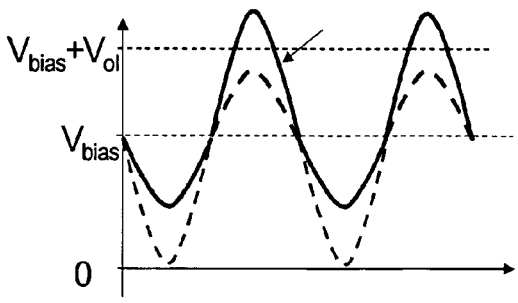
Figure 4. A sensed voltage signal Vc when one, two or three lamps are open in the OR gate detector of Fig. 3.
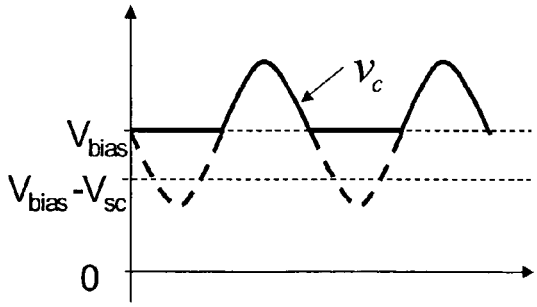
Figure 5. A sensed voltage signal Vc when one, two or three lamps are short in the OR gate detector of Fig.3.

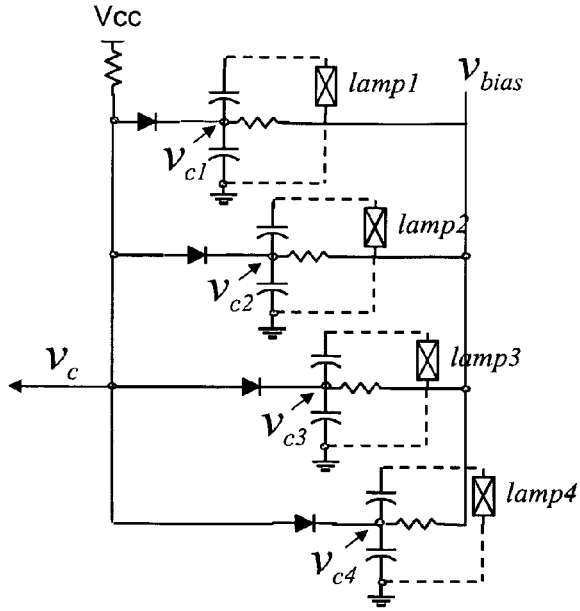
Figure 6. An AND gate detector with a DC bias.
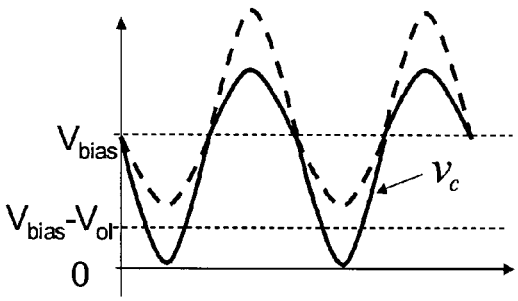
Figure 7. A sensed voltage signal Vc when one, two or three lamps are open in the AND gate detector of Fig. 6.
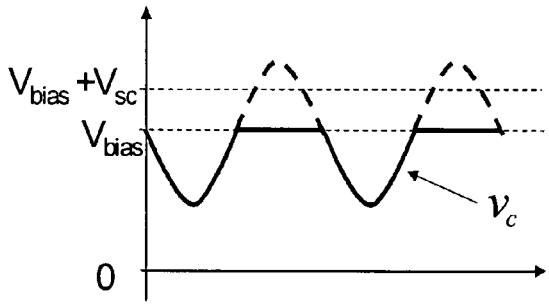
Figure 8. A sensed voltage signal Vc when one, two or three lamps are short in the AND gate detector of Fig. 6.

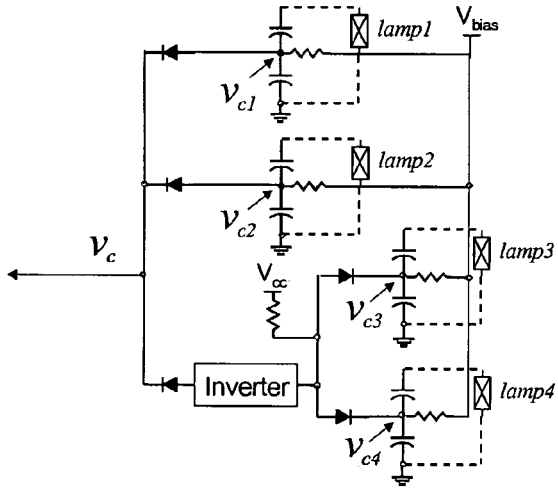

Figure 9. A schematic of a detector circuit in the out-of-phase applications by combining an inverter, an OR gate detector circuit, and an AND gate detector circuit.

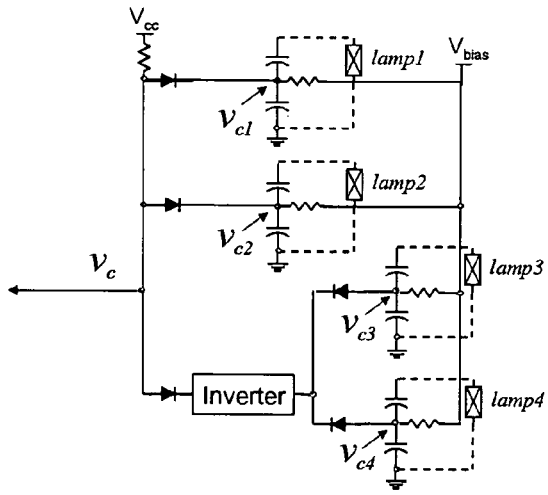

Figure 10. A schematic of a detector circuit in the out-of-phase applications by combining an inverter, an AND gate detector circuit, and an OR gate detector circuit.

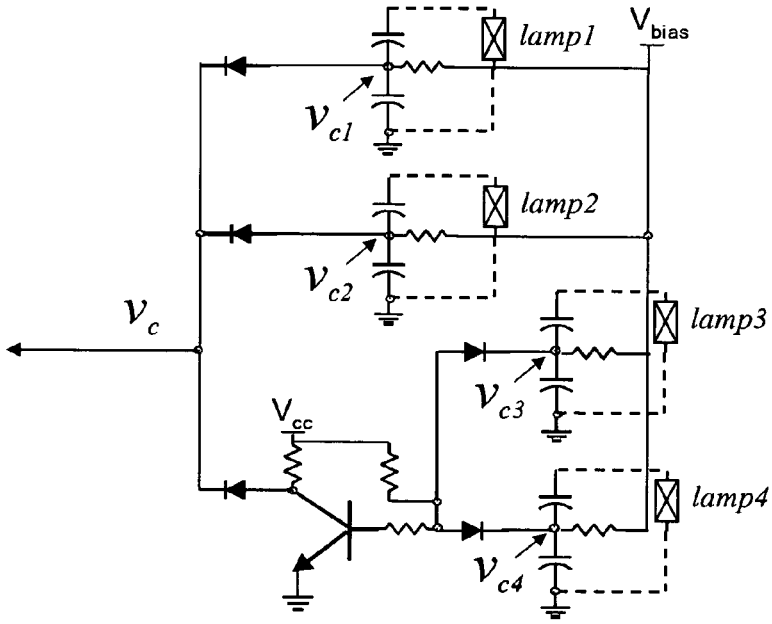

Figure 11. One example of the inverter in out-of-phase applications.

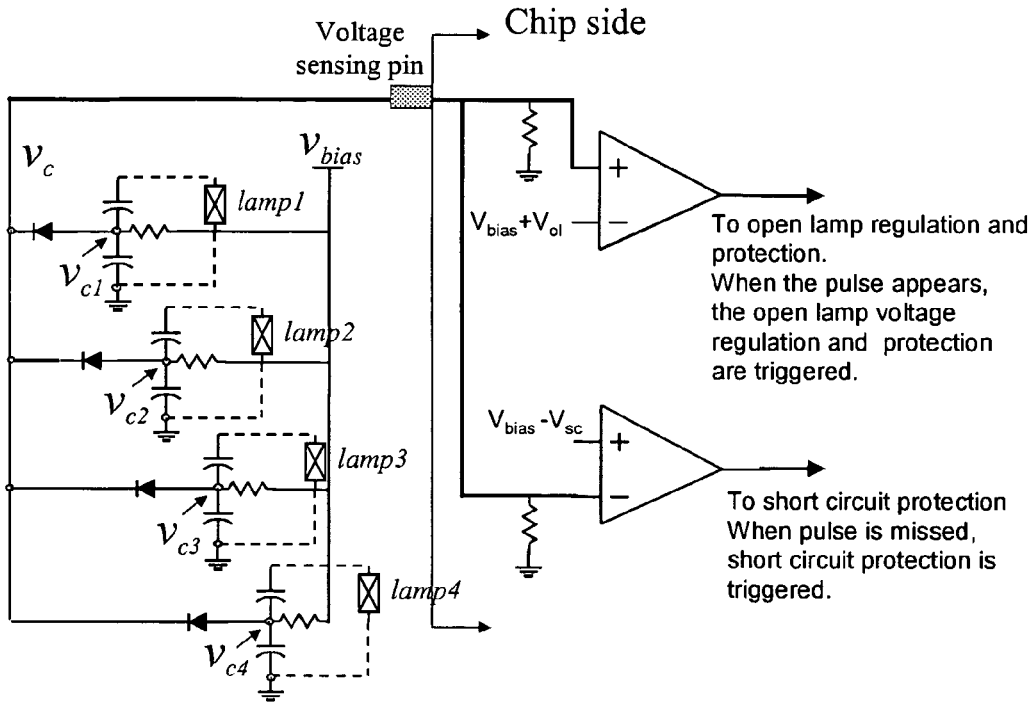
Figure 12. A protection triggering circuit using an output voltage from an OR gate detector circuit.
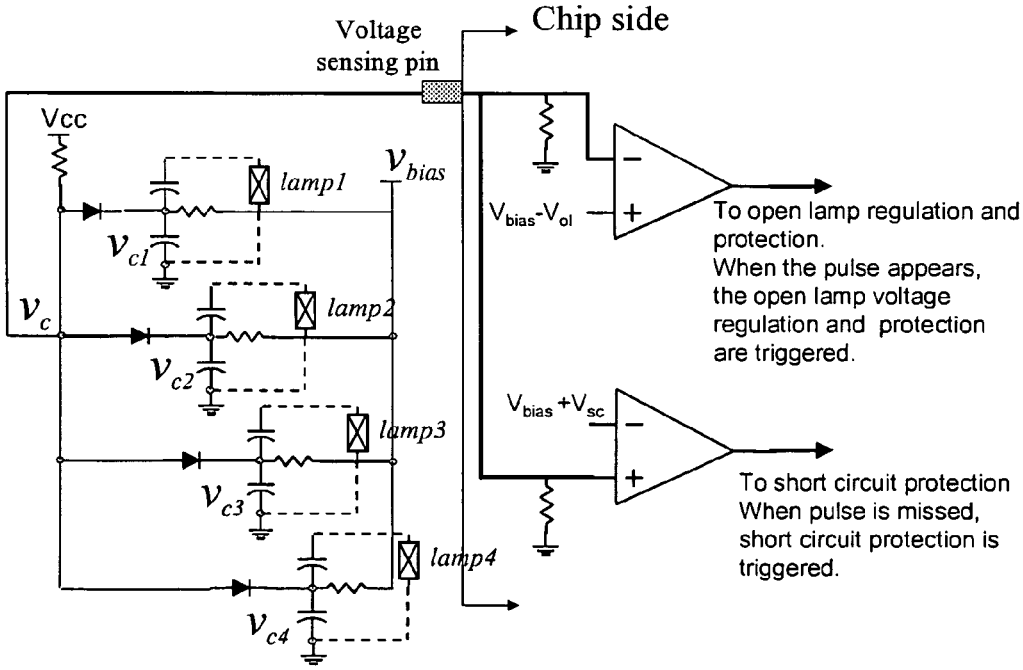
Figure 13. A protection triggering circuit using an output voltage from an AND gate detector circuit.

LAMP VOLTAGE FEEDBACK SYSTEM AND METHOD FOR OPEN LAMP PROTECTION AND SHORTED LAMP PROTECTION

TECHNICAL FIELD

The present invention relates to the driving of fluorescent lamps, and more particularly, to methods and protection schemes for driving cold cathode fluorescent lamps (CCFL), external electrode fluorescent lamps (EEFL), and flat fluorescent lamps (FFL). It is, but not exclusively, concerned with a circuit for driving one or more lamps which may be used for lighting a display.

BACKGROUND OF INVENTION

Open lamp voltage and short circuit protection schemes are often required in cold cathode fluorescent lamp (CCFL) inverter applications for safety and reliability reasons. In an open lamp condition, there might be a very large undesirable voltage occurring across the outputs if protections are not in place. This undesirable voltage may be several times higher than a nominal output and could be harmful to circuit components. In a shorted lamp condition, a protection circuit is desired to reduce the power level or to shut down the circuit completely to avoid circuit breakdown or other possible catastrophic situations.

A conventional method to achieve open lamp voltage protection is to monitor the winding current. A problem with this approach is that the winding current is not significantly reduced in an open lamp event because of large circulating energy. A conventional method to achieve shorted lamp protection is to measure capacitor voltage. In the shorted lamp condition, the voltage gain has a dramatic drop and it can be used as an indication of the short circuit condition. However, in a conventional CCFL inverter, open lamp voltage protection and shorted lamp protection are completely separate circuits. In order to achieve both open lamp protection and shorted lamp protection, not only are two sets of independent circuits necessary, but also two separate sets of pins are needed in the controller circuit. This results in unwanted complexity of the overall circuit and associated increase costs.

BRIEF DESCRIPTION OF DRAWINGS

The following figures illustrate embodiments of the invention. These figures and embodiments provide examples of the invention and they are non-limiting and non-exhaustive.

FIG. 1 shows the sensed voltage Vc across a sensing capacitor with and without a DC bias.

FIG. 2 is an example of gain curves of a typical CCFL inverter vs. frequency.

FIG. 3 is a schematic of an OR gate detector with a DC bias.

FIG. 4 shows a sensed voltage signal Vc when one, two or three lamps are open in the OR gate detector of FIG. 3.

FIG. 5 shows a sensed voltage signal Vc when one, two or three lamps are short in the OR gate detector of FIG. 3.

FIG. 6 is a schematic of an AND gate detector with a DC bias.

FIG. 7 shows a sensed voltage signal Vc when one, two or three lamps are open in the AND gate detector of FIG. 6.

FIG. 8 shows a sensed voltage signal Vc when one, two or three lamps are shorted in the AND gate detector of FIG. 6.

FIG. 9 is a schematic of a detector circuit in the out-of-phase applications by combining an inverter, an OR gate detector circuit, and an AND gate detector circuit.

FIG. 10 is a schematic of a detector circuit in the out-of-phase applications by combining an inverter, an AND gate detector circuit, and an OR gate detector circuit.

FIG. 11 is one example of the inverter in out-of-phase applications.

FIG. 12 shows a protection triggering circuit using an output voltage from an OR gate detector circuit.

FIG. 13 shows a protection triggering circuit using an output voltage from an AND gate detector circuit.

DETAILED DESCRIPTION

Embodiments of a system and method that uses logic and discrete components to achieve open lamp voltage protection and short circuit protection are described in detail herein. In the following description, some specific details, such as example circuits and example values for these circuit components, are included to provide a thorough understanding of embodiments of the invention. One skilled in relevant art will recognize, however, that the invention can be practiced without one or more specific details, or with other methods, components, materials, etc.

The following embodiments and aspects are illustrated in conjunction with systems, circuits, and methods that are meant to be exemplary and illustrative. In various embodiments, the above problem has been reduced or eliminated, while other embodiments are directed to other improvements.

The present invention relates to circuits and methods of open lamp voltage protection and shorted lamp protection in discharge lamp applications. The circuits can achieve both open lamp voltage protection and short circuit protection with only one pin required on the discharge lamp controller.

FIG. 1 shows the sensed voltage Vc across a sensing capacitor without and with a DC bias. The primary reason why circuits are complex in conventional methods is that only a half cycle of the lamp voltage can be used, which is illustrated as Vc without a bias voltage in FIG. 1. The disadvantage of these methods is that the negative part of waveform is usually ignored. In accordance with one embodiment of this invention, a DC voltage bias, $V_{bias}$, is added across the sensing capacitor in order to fully utilize the full waveform across sense capacitor. The capacitor voltage with $V_{bias}$ is plotted as Vc with bias voltage in FIG. 1. $V_{bias}$ in one embodiment equals Vcc/2, where Vcc is the source voltage. By adding the DC bias, the capacitor voltage is always above zero. This makes it easier to distinguish an open lamp condition or a shorted lamp condition from a normal operation condition than conventional methods.

An important characteristic of a CCFL inverter is its voltage gain under shorted lamp condition, normal loaded condition, and open lamp condition (or not loaded condition), which is illustrated in FIG. 2. With a switching frequency $f_s$ higher than the loaded resonant frequency $f_r$, the open lamp gain, G2, is larger than the gain, G1, under normal loaded condition. Further, the shorted lamp gain, G0, is smaller than G1. G0 virtually equals zero with an $f_s$ higher than $f_r$.

Another embodiment of this invention is to use an OR gate or an AND gate circuit to detect both open lamp condition and shorted lamp condition. A diode is added to each lamp in the circuit. For example, N diodes would be needed if there are N lamps in the circuit. For the simplicity of discussions, 4-lamp applications are discussed hereafter.

FIG. 3 shows a schematic of an OR gate detector circuit with a DC bias, $V_{bias}$. Each lamp is in series with a diode. Let's assume that the capacitor voltages of 4 lamps, Vc1 to Vc4, are all in phase. Under normal operation conditions, the waveform of Vc is the same as the waveform with a bias voltage in FIG. 1. When an open lamp condition occurs, the lamp voltage, Vci, of the lamp i would dramatically increase even without increasing the switching frequency, as indicated in FIG. 2. The increased lamp voltage can be used to indicate the open lamp condition. In the circuit of FIG. 3, Vc follows the largest Vci value wherein i is between 1 and 4. In the case of one or more lamps are open, Vc changes to the waveform shown by the solid line in FIG. 4. When Vc is higher than $V_{bias}$, it follows the open lamp voltage; and when Vc is lower than $V_{bias}$, it follows the lamp voltage under normal condition. Since the Vc peak under open lamp condition is significantly higher than that under normal condition, it can be used to indicate the open lamp condition and fed back to regulate the open lamp voltage. When Vc is higher than a threshold voltage, ($V_{bias}$+$V_{ol}$), the open lamp protection is triggered.

In the case of one or more lamps being shorted, Vc changes to the waveform shown by the solid line in FIG. 5. Since the shorted lamp voltage gain with $f_s$ under normal lamp condition is virtually equal to zero, the shorted lamp voltage with $V_{bias}$ equals to $V_{bias}$ in FIG. 3. When Vc is higher than $V_{bias}$, it follows the lamp voltage under normal condition; and when Vc is not higher than $V_{bias}$, it equals to $V_{bias}$. The valley of the waveforms disappears. Therefore, the valley of the waveform can be used to indicate whether any lamp is shorted or not. As long as the sensed voltage is always higher than a threshold voltage ($V_{bias}$−$V_{sc}$) in one switching cycle, the shorted lamp protection is triggered.

In an alternative embodiment, an AND gate detector circuit can also be used in open lamp and shorted lamp protections. FIG. 6 shows an AND gate detector circuit with a DC bias, $V_{bias}$, and a voltage source, Vcc. Each lamp is in series with a diode. In the circuit of FIG. 6, Vc always follows the lowest Vci value wherein i is between 1 and 4. Assuming that the capacitor voltages of 4 lamps, Vc1, Vc2, Vc3, and Vc4, are in phase, under normal operation, the waveform of Vc is the same as the waveform with a bias voltage in FIG. 1. In the case of one or more lamps are open, Vc changes to the waveform shown by the solid line in FIG. 7. When Vc is higher than $V_{bias}$, it follows the lamp voltage under normal condition; and when Vc is lower than $V_{bias}$, it follows the open lamp voltage. Since the valley of Vc waveforms under open lamp condition is significantly lower than that under normal condition, this can be used to indicate the open lamp condition and fed back to trigger the open lamp protection. When Vc is lower than a threshold voltage, ($V_{bias}$−$V_{ol}$), the open lamp voltage protection is triggered.

In the case of one or more lamps are shorted, Vc changes to the waveform shown by the solid line in FIG. 8. When Vc is lower than $V_{bias}$, it follows the lamp voltage under normal condition; and when Vc is not lower than $V_{bias}$, it equals to Vias. The peak of the waveform disappears. Therefore, the peak of the waveform can be used to indicate whether any lamp is shorted or not. As long as the sensed voltage is always lower than a threshold voltage ($V_{bias}$+$V_{sc}$) in one switching cycle, the shorted lamp protection is triggered.

Another embodiment of this invention can be advantageously used in out-of-phase multiple-lamp applications. Assuming that the phases of the lamp voltages are either 0 degrees or 180 degrees, respectively, one solution is to use two sets of detector circuits in FIG. 3 or FIG. 6. The first circuit is to monitor all the lamps with 0 degree phase and the second circuit is to monitor all the lamps with 180 degree phase. Each circuit can detect and trigger both open lamp protection and shorted lamp protection.

Another embodiment is illustrated in FIG. 9 and FIG. 10. FIG. 9 shows a detector circuit in the "out-of-phase application" with a combination of OR gate and AND gate detector circuits. FIG. 10 shows a detector circuit in the out-of-phase application with a combination of AND gate and OR gate detector circuits. In both FIG. 9 and FIG. 10, the capacitor voltages, Vc1 and Vc2, cross the first and second lamps are in phase at 0 degrees; and the capacitor voltages, Vc3 and Vc4, cross the third and fourth lamps are in phase at 180 degrees. An inverter and a diode are added to the sensing capacitors of the third and fourth lamps. The inverter changes the phase of the output capacitor voltage of the third and fourth lamps from 180 degrees to 0 degrees. Then, the phases of all capacitor voltages are effectively in phase at 0 degrees. As a result, both open lamp protection and shorted lamp protection in out-of-phase cases can be triggered the same as the in-phase cases.

There are many ways to accomplish the inverter. One simple way is to use an NPN transistor, which is illustrated in FIG. 11. The base of the transistor is connected to both the diode of the third lamp and the diode of the fourth lamp, through a resistor. The emitter of the transistor is grounded and the collector of the transistor is connected to a voltage source through a resistor. When the voltage at the base goes up, there is more current through the collector and the voltage at collector goes down. Conversely, when the voltage at the base goes down, there is less current through the collector and the voltage at the collector goes up. This NPN transistor effectively changes the voltage at its base from 180 degrees phase to the voltage at its collector with a 0 degree phase.

Another aspect of this invention is the protection triggering circuit, which uses the output voltage signal Vc from the detector circuits. The protection triggering circuit can be implemented on the integrated circuit level. FIG. 12 illustrates a protection triggering circuit using an OR gate detector circuit. The Vc voltage from the OR gate detector circuit is coupled to a voltage sensing pin. Through the voltage sensing pin, Vc is coupled to the integrated circuit level and feeds the positive terminal of a comparator, CMP1, and feeds the negative terminal of another comparator, CMP2. CMP1 compares Vc with a reference voltage ($V_{bias}$+$V_{ol}$) and triggers the open lamp voltage protection once a pulse appears. CMP2 compares Vc with a reference voltage ($V_{bias}$−$V_{sc}$) and triggers the shorted lamp protection once a pulse is missed.

FIG. 13 illustrates a protection circuit using an AND gate detector circuit. The Vc voltage from the AND gate detector circuit is coupled to a voltage sensing pin. Through the voltage sensing pin, Vc is coupled to the integrated circuit level and feeds the negative terminal of a comparator, CMP1, and feeds the positive terminal of another comparator, CMP2. CMP1 compares Vc with a reference voltage ($V_{bias}$−$V_{ol}$) and triggers the open lamp voltage protection once a pulse appears. CMP2 compares Vc with a reference voltage ($V_{bias}$+$V_{sc}$) and triggers the shorted lamp protection once a pulse is missed.

Note that from the discussion above, one advantage of the present invention is that only one pin is needed to achieve both open lamp protection and shorted lamp protection with a much simpler circuit and lower cost.

In one embodiment of the present invention, the DC bias $V_{bias}$, preferably equals (Vcc/2), and is added across sensing capacitors of discharge lamps. By adding $V_{bias}$, the sensing capacitor voltages are above zero. An OR gate or AND gate detector circuit is used to couple multiple discharge lamps through sensing capacitors and to output an overall capacitor voltage. The overall capacitor voltage from detector circuits is coupled to one pin on the discharge lamp controller. Through the pin, the capacitor voltage is coupled to the integrated circuit level and is used to trigger both open lamp protection and shorted lamp protection. In accordance with this invention, only one detector circuit and one pin are needed for both open lamp and shorted lamp protections. This is much simpler than conventional methods and circuits. This invention can be applied to both in-phase discharge lamp applications and also to out-of-phase discharge lamp applications. In out-of-phase applications, additional inverters are needed to convert sensing capacitor voltages with phase from 180 degrees to 0 degrees, or from 0 degrees to 180 degrees.

The description of the invention and its applications as set forth herein is illustrative open lamp voltage protection and short circuit protection and is not intended to limit the scope of the invention. Variations and modifications of the embodiments disclosed herein are possible, and practical alternatives to and equivalents of the various elements of the embodiments are known to those of ordinary skill in the art. Other variations and modifications of the embodiments disclosed herein may be made without departing from the scope and spirit of the invention.

We claim:

1. A method for detecting an open lamp condition or a shorted lamp condition in a discharge lamp system, comprising:

providing a DC bias, $V_{bias}$, from a DC bias source to an OR gate detector circuit that is coupled to a plurality of discharge lamps, said OR gate detector circuit including:

a plurality of sensing capacitors being coupled to said DC bias source and said plurality of discharge lamps, wherein one sensing capacitor corresponds to one discharge lamp; and a plurality of diodes being coupled to said plurality of sensing capacitors, wherein one diode corresponds to one sensing capacitor; and deriving a voltage signal from said OR detector circuit;

if said voltage signal satisfies an open lamp condition, triggering an open lamp protection process; and if said voltage signal satisfies a shorted lamp condition, triggering a shorted lamp protection process, wherein said voltage signal is related to a maximum sensing capacitor voltage of said plurality of discharge lamps at any given moment.

2. The method in claim 1, further comprising:

coupling said voltage signal to a pin on a controller of said discharge lamp system; and coupling said voltage signal to a protection triggering circuit on an integrated circuit level to trigger the open lamp protection process or the shorted lamp protection process through said pin.

3. The method in claim 1, wherein said plurality of sensing capacitors comprise a first plurality of sensing capacitors and a second plurality of sensing capacitors, and wherein said OR gate detector circuit further comprises:

said first plurality of sensing capacitors being coupled to said DC bias source and said plurality of discharge lamps, wherein the voltages of said first plurality of sensing capacitors are in phase;

a first plurality of diodes being coupled to said first plurality of sensing capacitors, wherein one diode corresponds to one sensing capacitor;

an additional diode being coupled to said first plurality of diodes;

an inverter being coupled to said additional diode;

a second plurality of diodes being coupled to said inverter;

a voltage source being coupled to said second plurality of diodes and said inverter through a first resistor; and said second plurality of sensing capacitors being coupled to said DC bias source and said second plurality of diodes, wherein one diode corresponds to one sensing capacitor and voltages of said second plurality of sensing capacitors are 180 degrees out-of-phase with said first plurality of sensing capacitors.

4. The method in claim 3, wherein said inverter is an NPN transistor with its base being coupled to said second plurality of diodes through a second resistor, its emitter being coupled to ground, and its collector being coupled to said additional diode and through a third resistor to said voltage source.

5. The method in claim 1, wherein the open lamp protection process is triggered when said voltage signal is higher than a threshold voltage, $(V_{bias}+V_{oi})$, and the shorted lamp protection process is triggered when said voltage signal is higher than a threshold voltage, $(V_{bias}-V_{sc})$, in one switching cycle.

6. A method for detecting an open lamp condition or a shorted lamp condition in a discharge lamp system, comprising:

providing a DC bias. $V_{bias}$, from a DC bias source to an AND gate detector circuit that is coupled to a plurality of discharge lamps, said AND gate detector circuit including:

a plurality of sensing capacitors being coupled to said DC bias source and said plurality of discharge lamps, wherein one sensing capacitor corresponds to one discharge lamp;

a plurality of diodes being coupled to said plurality of sensing capacitors, wherein one diode corresponds to one sensing capacitor; and a voltage source being coupled to said plurality of diodes through a first resistor; and deriving a voltage signal from said AND detector circuit;

if said voltage signal satisfies an open lamp condition, triggering an open lamp protection process; and if said voltage signal satisfies a shorted lamp condition, triggering a shorted lamp protection process, wherein said voltage signal is related to the minimum sensing capacitor voltage of said plurality of discharge lamps at any given moment.

7. The method in claim 6, wherein said plurality of sensing capacitors comprise a first plurality of sensing capacitors and a second plurality of sensing capacitors, and wherein said AND gate detector circuit further comprises:

said first plurality of sensing capacitors being coupled to said DC bias source and said plurality of discharge lamps, wherein said first plurality of sensing capacitors are in phase;

a first plurality of diodes being coupled to said first plurality of sensing capacitors wherein one diode corresponds to one sensing capacitor;

an additional diode being coupled to said first plurality of diodes;

a voltage source being coupled to said additional diode and said first plurality of diodes through a first resistor;

an inverter being coupled to said additional diode;

a second plurality of diodes being coupled to said inverter; and said second plurality of sensing capacitors being coupled to said DC bias source and said second plurality of diodes wherein one diode is corresponding to one sensing capacitor and voltages of said second plurality of sensing capacitors are 180 degrees out-of-phase with said first plurality of sensing capacitors.

8. The method in claim 7, wherein said inverter is an NPN transistor with its base being coupled to said second plurality of diodes through a second resistor, its emitter being coupled to ground, and its collector being coupled to said additional diode and through a third resistor to said voltage source.

9. The method in claim 7, wherein the open lamp protection process is triggered once said voltage signal lower than a threshold voltage, ($V_{bias}-V_{ol}$), and the shorted lamp protection process is triggered once said voltage signal always lower than a threshold voltage, ($V_{bias}+V_{sc}$), in one switching cycle.

10. A circuit capable of detecting an open lamp condition or a shorted lamp condition, and triggering an open lamp process or a shorted lamp protection process in a discharge lamp system, comprising:

a detector circuit coupled to a plurality of discharge lamps that outputs a voltage signal, the detector circuit including a plurality of sensing capacitors being coupled to said plurality of discharge lamps wherein one sensing capacitor corresponds to one discharge lamp;

a plurality of diodes being coupled with said plurality of sensing capacitors wherein one diode corresponds to one sensing capacitor; and a DC bias source, for providing a bias voltage $V_{bias}$, being coupled to said plurality of sensing capacitors so that all sensing capacitor voltages are larger than zero; and a protection triggering circuit for receiving said voltage signal from said detector circuit and triggering the open lamp protection process if at least one lamp is open; and the shorted lamp protection process if at least one lamp is shorted.

11. The circuit in claim 10, wherein said plurality of sensing capacitors comprise a first plurality of sensing capacitors and a second plurality of sensing capacitors, and wherein said detector circuit is an OR gate detector circuit combining an AND gate detector circuit, said detector circuit further comprising:

said first plurality of sensing capacitors being coupled to said DC bias source and said discharge lamps, wherein voltages of said first plurality of sensing capacitors are in phase;

a first plurality of diodes being coupled to said first plurality of sensing capacitors wherein one diode corresponds to one sensing capacitor;

an additional diode being coupled to said first plurality of diodes;

an inverter being coupled to said additional diode;

a second plurality of diodes being coupled to said inverter;

a voltage source being coupled to said second plurality of diodes and said inverter through a first resistor; and said second plurality of sensing capacitors being coupled to said second plurality of diodes wherein one diode corresponds to one sensing capacitor and voltages of said second plurality of sensing capacitors are 180 degrees out-of-phase with said first plurality of sensing capacitors.

12. The detector circuit in claim 11, wherein said inverter is an NPN transistor with its base being coupled to said second plurality of diodes through a second resistor, its emitter being coupled to ground, and its collector being coupled to said additional diode and through a third resistor to said voltage source.

13. The circuit in claim 10, wherein said detector circuit is an AND gate detector circuit combining an OR gate detector circuit, said detector circuit further comprising:

a plurality of diodes being coupled to said plurality of sensing capacitors wherein one diode corresponds to one sensing capacitor; and a voltage source being coupled to said plurality of diodes through a first resistor.

14. The circuit in claim 10, wherein said protection triggering circuit is on an integrated circuit level.

15. The circuit in claim 10, wherein said protection triggering circuit comprises:

a first threshold detector; and a second threshold detector.

16. The circuit in claim 15, wherein said first threshold detector triggers the open lamp protection process when said voltage signal is higher than a threshold voltage, ($V_{bias}+V_{Ol}$), and the shorted lamp protection process when said voltage signal is always higher than a threshold voltage, ($V_{bias}-V_{sc}$), in one switching cycle.

17. The circuit in claim 15, wherein said first threshold detector triggers the open lamp protection process when said voltage signal is lower than a threshold voltage, ($V_{bias}-V_{ol}$), and the shorted lamp protection process when said voltage signal is always lower than a threshold voltage ($V_{bias}+V_{sc}$) in one switching cycle.

18. The circuit in claim 15, wherein said first and second threshold detectors are comparators.

19. A circuit capable of detecting an open lamp condition or a shorted lamp condition, and triggering an open lamp process or a shorted lamp protection process in a discharge lamp system, comprising:

a detector circuit coupled to a plurality of discharge lamps that outputs a voltage signal, the detector circuit including:

a first plurality of sensing capacitors being coupled to a first plurality of discharge lamps wherein one sensing capacitor corresponds to one discharge lamp and voltages of said first plurality of sensing capacitors are in phase;

a first plurality of diodes being coupled to said first plurality of sensing capacitors wherein one diode corresponds to one sensing capacitor;

an additional diode being coupled to said first plurality of diodes;

a voltage source being coupled to said individual diode and said first plurality of diodes through a first resistor;

an inverter being coupled to said additional diode;

a second plurality of diodes being coupled to said inverter;

a second plurality of sensing capacitors being coupled to said second plurality of diodes wherein one diode corresponds to one sensing capacitor and voltages of said second plurality of sensing capacitors are 180 degrees out-of-phase with said first plurality of sensing capacitors; and a DC bias source, for providing a bias voltage $V_{bias}$, being coupled to said first and second pluralities of sensing capacitors; and a protection triggering circuit for receiving said voltage signal from said detector circuit and triggering the open lamp protection process if at least one lamp is open; and the shorted lamp protection process if at least one lamp is shorted.

20. The detector circuit in claim 19, wherein said inverter is an NPN transistor with its base being coupled to said second plurality of diodes through a second resistor, its emitter being coupled to ground, and its collector being coupled to said additional diode and through a third resistor to said voltage source.

21. The method in claim 19, further comprising:

coupling said voltage signal to a pin on a controller of said discharge lamp system; and coupling said voltage signal to a protection triggering circuit on an integrated circuit level to trigger the open lamp protection process or the shorted lamp protection process through said pin.

22. The circuit in claim 19, wherein said protection triggering circuit is on an integrated circuit level.

23. The circuit in claim 19, wherein said protection triggering circuit comprises:

a first threshold detector; and a second threshold detector.

24. The circuit in claim 23, wherein said first threshold detector triggers the open lamp protection process when said voltage signal is higher than a threshold voltage, ($V_{bias}V_{ol}$), and the shorted lamp protection process when said voltage signal is always higher than a threshold voltage, ($V_{bias}-V_{sc}$), in one switching cycle.

25. The circuit in claim 23, wherein said first threshold detector triggers the open lamp protection process when said voltage signal is lower than a threshold voltage, ($V_{bias}-V_{ol}$), and the shorted lamp protection process when said voltage signal is always lower than a threshold voltage ($V_{bias}+V_{sc}$) in one switching cycle.

26. The circuit in claim 23, wherein said first and second threshold detectors are comparators.

* * * * *